US006287690B1

(12) United States Patent
Land

(10) Patent No.: US 6,287,690 B1
(45) **Date of Patent: *Sep. 11, 2001**

(54) FIRE RESISTANT CORESPUN YARN AND FABRIC COMPRISING SAME

(75) Inventor: Frank J. Land, Freeport, NY (US)

(73) Assignee: Land Fabric Corporation, Island Park, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/624,772

(22) Filed: Jul. 25, 2000

Related U.S. Application Data

(63) Continuation of application No. 09/406,732, filed on Sep. 28, 1999, now Pat. No. 6,146,759.

(51) Int. Cl.[7] ..... D01F 8/00
(52) U.S. Cl. ..... 428/370; 428/373; 428/377
(58) Field of Search ..... 428/370, 373, 428/377; 57/230, 210

(56) References Cited

U.S. PATENT DOCUMENTS

| | | |
|---|---|---|
| 3,366,001 | 1/1968 | Meserole . |
| 3,439,491 | 4/1969 | Scruggs . |
| 3,572,397 | 3/1971 | Austin . |
| 3,729,920 | 5/1973 | Savers et al. . |
| 3,886,015 | 5/1975 | Turner . |
| 3,913,309 | 10/1975 | Chiarotto . |
| 4,024,700 | 5/1977 | Drummond . |
| 4,263,777 | 4/1981 | Wada et al. . |
| 4,299,884 | 11/1981 | Paven . |
| 4,331,729 | 5/1982 | Weber . |
| 4,381,639 | 5/1983 | Kress . |
| 4,500,593 | 2/1985 | Weber . |
| 4,502,364 | 3/1985 | Zucker et al. . |
| 4,541,231 | 9/1985 | Graham, Jr. et al. . |
| 4,670,327 | 6/1987 | Weber . |
| 4,868,041 | 9/1989 | Yamagishi . |
| 4,921,756 | 5/1990 | Tolbert et al. . |
| 4,927,698 | 5/1990 | Jaco et al. . |
| 4,958,485 | 9/1990 | Montgomery et al. . |
| 5,496,625 | 3/1996 | Lilani . |
| 5,540,980 | 7/1996 | Tolbert et al. . |
| 6,146,759 * | 11/2000 | Land ..... 428/370 |

FOREIGN PATENT DOCUMENTS

| | | |
|---|---|---|
| 1 593 048 | 7/1981 | (GB) . |
| 0 059 585 | 10/1982 | (JP) . |
| 0 100 323 | 1/1983 | (JP) . |
| 0 107 608 | 6/1985 | (JP) . |
| 0 261 330 | 11/1986 | (JP) . |
| 0 141 041 | 6/1989 | (JP) . |

OTHER PUBLICATIONS

International Search Report issued in Application No. PCT/US00/22956.

* cited by examiner

*Primary Examiner*—Newton Edwards
(74) *Attorney, Agent, or Firm*—Burns, Doane, Swecker & Mathis, LLP

(57) ABSTRACT

Provided is a fire resistant corespun yarn. The yarn includes a core of a high temperature resistant continuous filament comprising fiberglass and a low temperature synthetic continuous filament selected from nylon, polyester, polyethylene and polyolefin, the core being two-plied. A first sheath of blended staple fibers surrounds the core. The fibers include modacrylic fibers and melamine fibers. A second sheath of staple fibers surrounds the first corespun yarn. This double corespun yarn may be woven and knit in fine, non-plied or plied form and extends the range of fineness of fabrics below heretofore achievable limits. Also provided is a fire resistant fabric which includes a fire resistant fabric substrate formed from the fire resistant corespun yarn, as well as a product upholstered with the fire resistant fabric.

20 Claims, 1 Drawing Sheet

FIRE RESISTANT CORESPUN YARN AND FABRIC COMPRISING SAME

This application is a continuation, of Application No. 09/406,732, filed Sep. 28, 1999, now U.S. Pat. No. 6,146, 759.

BACKGROUND OF THE INVENTION

1. Field of the Invention

The invention relates to a fire resistant yarn and to a method of preparing a fire resistant yarn. The invention also relates to a fabric which includes the fire resistant yarn. The invention has particular applicability in the formation of fire resistant fabrics for applications such as upholstery, mattress and pillow ticking, bed spreads, pillow covers, draperies or cubicle curtains, wallcoverings, window treatments and baby clothing.

2. Description of the Related Art

It is well known in the textile industry to produce fire resistant fabrics for use as upholstery, mattress ticking, panel fabric and the like, using yarn formed of natural or synthetic fibers, and then treating the fabric with fire retarding chemicals. Conventional fire retarding chemicals include halogen-based and/or phosphorus-based chemicals. Unfortunately, such treated fabric is heavier than similar types of non-fire retardant fabrics, and further has a limited wear life. Also, this type of fabric typically melts or forms brittle chars which break away when the fabric is burned, and exposes the foam of a composite chair, mattress or panel fabric system. The exposed foam then acts as a fuel source.

It is also known to form fire resistant fabrics of fire resistant, relatively heavy weight yarns in which a low temperature resistant fiber is ring spun around a core of continuous filament fiberglass. However, this type of ring spun yarn has torque imparted thereto during the spinning process and is very lively. Because of the lively nature of the yarn, it is necessary to ply "S" and "Z" ring spun yarns together so that the torque and liveliness in the yarn is balanced in order to satisfactorily leave or knit the yarn into the fabric, without experiencing problems of tangles occurring in the yarn during the knitting or weaving process. This plying of the "S" and "Z" yarns together results in a composite yarn which is so large that it cannot be used in the formation of fine textured, lightweight fabrics. In some instances, the fiberglass filaments in the core protrude through the natural fiber sheath. It is believed that the problem of protruding core fibers is associated with the twist, torque and liveliness being imparted to the fiberglass core during the ring spinning process.

It is the current practice to produce coated upholstery fabrics by weaving or knitting a substrate or scrim of a cotton or cotton and polyester blend yarn. This scrim is then coated with a layered structure of thermoplastic polyvinyl halide composition, such as polyvinyl chloride (PVC). This coated upholstery fabric has very little, if any, fire resistance and no flame barrier properties. In addition to the coating chemical having a limited shelf life, the chemical coatings are disadvantageous in that they pose a safety hazard in case of contact with skin.

SUMMARY OF THE INVENTION

To overcome or conspicuously ameliorate the disadvantages of the related art, it is an object of the present invention to provide a novel fire resistant corespun yarn. As used herein, the term "fire resistant" means that when, in the form of a woven or a knitted fabric composed entirely of the yarn, it satisfies the requirements of the standard Technical Bulletin, California 133 Test Method (Cal. 133).

It is a further object of the invention to provide a fire resistant fabric which includes the fire resistant corespun yarn in a fire resistant fabric substrate.

It is a further object of the invention to provide a product upholstered with the fire resistant fabric.

The corespun yarn can advantageously be used in forming fine textured or nontextured fire resistant decorative fabrics. Upon exposure to flame and high heat, sheathings of staple fibers surrounding and covering a core become charred and burnt, yet remain in position around the core to create a thermal insulation barrier. The char effectively can block the flow of oxygen and other gases, preventing the fabric from igniting.

In addition, the fabrics woven or knit with the corespun yarn of the present invention can advantageously be dyed and printed with conventional dying and printing materials. These fabrics are particularly suitable for forming fine textured fire resistant flame barrier decorative fabrics for use in upholstery, panel fabrics, mattress and pillow ticking, draperies or cubicle curtains, wallcoverings, window treatments and baby clothing.

In accordance with a first aspect of the invention, a fire resistant corespun yarn is provided. The corespun yarn includes a core of a high temperature resistant continuous filament comprising fiberglass. A first sheath of blended staple fibers surrounds the core, the fibers including modacrylic fibers and melamine fibers. A second sheath of staple fibers surrounds the first corespun yarn.

In accordance with a particularly preferred embodiment of the invention, the core has a structure which includes a low temperature resistant continuous filament synthetic fiber selected from the group consisting of polyethylene, nylon, polyester and polyolefin, two-plied with the fiberglass filament.

In accordance with a further aspect of the invention, a fire resistant corespun yarn is provided. The corespun yarn includes a two-plied core of a high temperature resistant continuous filament comprising fiberglass and a low temperature resistant continuous filament synthetic fiber selected from the group consisting of polyethylene, nylon, polyester and polyolefin. A first sheath of blended staple fibers surrounds the core, the fibers including modacrylic fibers and melamine fibers. A second sheath of staple fibers surrounds the first corespun yarn. The core accounts for from about 15 to 35% by weight based on the total weight of the corespun yarn, and the second sheath accounts for from about 35 to 80% by weight based on the total weight of the corespun yarn.

In accordance with yet another aspect of the invention, a fire resistant fabric is provided. The fabric includes a fire resistant fabric substrate, which includes the fire resistant corespun yarn.

In accordance with yet another aspect of the invention, a product upholstered with the fire resistant fabric is provided. The product can advantageously be free of a fire resistant coating and of a barrier fabric.

Other objects, advantages and aspects of the present invention will become apparent to one of ordinary skill in the art on a review of the specification, drawings and claims appended hereto.

BRIEF DESCRIPTION OF THE DRAWINGS

The objects and advantages of the invention will become apparent from the following detailed description of the preferred embodiments thereof in connection with the accompanying drawings, in which like numerals designate like elements, and in which.

DETAILED DESCRIPTION OF PREFERRED EMBODIMENTS OF THE INVENTION

Figure 1:
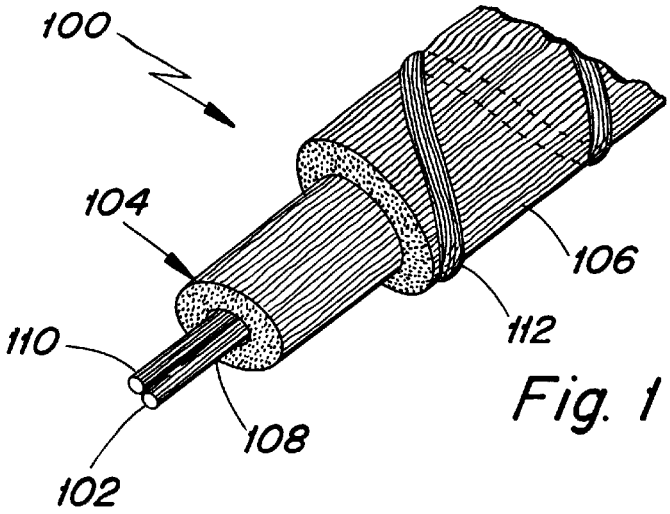
FIG. 1 is an enlarged view of a fragment of the balanced double corespun yarn in accordance with the present invention.

Preferred embodiments of the invention will now be described with reference to FIG. 1, which illustrates an exemplary fire resistant multi-corespun yarn in accordance with one aspect of the invention. While the exemplary fire resistant yarn is a balanced double corespun yarn, it should be clear that triple or more corespun yarns are also envisioned.

The basic structure of the yarn 100 in accordance with the invention includes a filament core 102 completely surrounded by a first sheath 104, and a second sheath 106 completely surrounding the first sheath 104.

Core 102 is formed from a high temperature resistant continuous filament fiberglass 108, two-plied with a low temperature resistant continuous filament synthetic fiber 110. The core 102 is preferably from about 15 to 35% by weight based on the total weight of the corespun yarn.

Suitable continuous filament fiberglass materials for use in the core 102 are commercially available, for example, from PPG. The filament fiberglass 108 is preferably from about 10 to 30% by weight of the total weight of the double corespun yarn 100.

Preferably, synthetic fiber 110 is formed of a synthetic (i.e., man made) material selected from the group consisting of a polyethylene, a nylon, a polyester and a polyolefin. Of these, nylon is particularly preferred. Suitable continuous synthetic fiber filaments are commercially available, for example, continuous filament nylon from BASF. Synthetic fiber 110 is preferably from about 5 to 25% by weight of the total weight of the double corespun yarn 100. While a two-plied core structure has been exemplified, it should be clear that other multi-plied core structures can be used.

First sheath 104 is a medium to high temperature staple fiber blended sheath. The fiber blend comprises two or more different types of synthetic fibers which include blended modacrylic and melamine staple fibers surrounding the two-plied core 102. Modacrylic fiber is a stable fiber which chars and expands when exposed to open flame, while melamine fiber is a high temperature resistant, unstable brittle fiber. The modacrylic fiber acts as a carrying agent for the melamine fiber which, when blended, creates a stable/flexible high temperature resistant material. Suitable modacrylics are sold under the tradenames Protex® (M) or Protex® (S), while melamine fiber is commercially available from BASF under the tradename Basofil®.

In the fiber blend, the modacrylic staple fibers preferably account for from about 50 to 90% by weight of the total weight of the first sheath, while the melamine fibers preferably account for from about 10 to 50% by weight of the total weight of the first sheath. The first sheath 104 is preferably from about 10 to 40% by weight of the total weight of the double corespun yarn 100.

Second sheath 106 is a low to medium temperature chopped staple fiber sheath surrounding the core 102 and first sheath 104 (i.e., the first core spun yarn) to create the product double sheath corespun yarn 100. The low to medium temperature resistant staple fibers of the second sheath 106 are preferably selected from a variety of different types of either natural (e.g., vegetable, mineral or animal) or synthetic fibers, such as cotton, wool, nylon, polyester, polyolefin, rayon, acrylic, silk, mohair, cellulose acetate, or blends of such fibers. Of these, the preferred low to medium temperature resistant staple fibers are cotton or polyolefin. The second sheath 106 is preferably from about 35% to 80% of the total weight of the double corespun yarn 100.

The two-plied continuous fiberglass and synthetic filaments 108, 110 of the core 102 extend generally longitudinally in an axial direction of the double corespun yarn 100. The majority of the staple fibers of the first sheath 104 and of the second sheath 106 extend around core 102 in a slightly spiraled direction. A minor portion, for example, from about 35 to 80%, of the staple fibers of each of the sheaths form a binding wrapper spirally around the majority of the staple fibers, as indicated at 112, in a direction opposite the majority of staple fibers. The first sheath 104 hence surrounds and completely covers the two-plied core 102, and the second sheath 106 surrounds and completely covers the first sheath 104. The outer surface of the double corespun yarn has the appearance and general characteristics of the low to medium temperature resistant fibers forming the second sheath 106.

The size of the product yarn will vary depending on the final application of the yarn and the particular fabric characteristics desired, but is preferably within the range of from about 30/1 to 1/1 conventional cotton count, preferably from about 21/1 to 10/1 conventional cotton count.

The product multi-corespun yarn is balanced and has very little if any torque or liveliness. This characteristic allows the yarn to be woven or knitted in single end manner without the need for two ends to be plied to balance the torque. As a result, fine textured fabrics can be formed having heat resistant properties which have not been possible to date.

Figure 2:
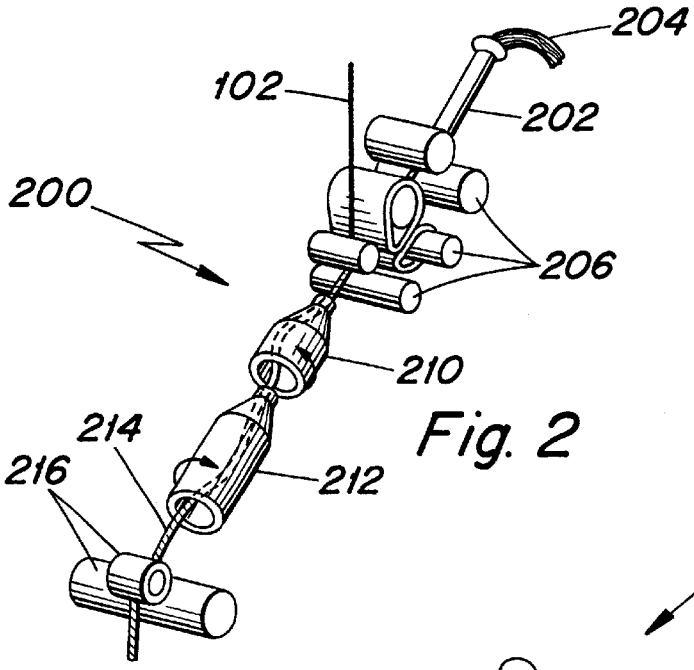
FIG. 2 is a schematic diagram of an air jet spinning apparatus of the type utilized in forming the fine denier corespun yarn and double corespun yarn of the present invention.

A method for forming the double corespun yarn 100 in accordance with the invention will now be described with reference to FIG. 2. As pointed out above, the double corespun yarn 100 of the present invention is preferably produced on an air jet spinning apparatus 200 of the type illustrated. Such an apparatus is commercially available, for example, from Murata of America, Inc., and is described in the literature. See, e.g., U.S. Pat. Nos. 5,540,980, 4,718,225, 4,551,887 and 4,497,167, the entire contents of which patents are incorporated herein by reference.

The air jet spinning apparatus 200 includes an entrance trumpet 202 into which a sliver of medium to high temperature resistant staple fibers 204 is fed. Staple fibers 204 are then passed through a set of paired drafting rolls 206. A continuous filament fiberglass and low temperature continuous filament synthetic two-plied core 102 is fed between the last of the paired drafting rolls 206 and onto the top of the staple fibers 204.

The two-plied core 102 and staple fibers 204 then pass through a first fluid swirling airjet nozzle 210, and a second fluid swirling air jet nozzle 212, thereby forming a first corespun yarn 214. The first and second air jet nozzles 210, 212 are constructed to produce swirling fluid flows in opposite directions, as indicated by the arrows. The action of first air jet nozzle 210 causes the staple fibers 204 to be wrapped or spiraled around the two-plied core 102 in a first direction. The oppositely operating air jet nozzles 210, 212 causes a minor portion, for example, from about 5 to 20%, of the staple fibers to separate and wind around the unseparated staple fibers in a direction opposite the majority fiber spiral. The wound staple fibers maintain the first sheath 104 in close contact surrounding and covering the two-plied core 102. The first corespun yarn 214 is then drawn from the second nozzle 212 by a delivery roll assembly 216 and is wound onto a take-up package (not shown).

The same air jet spinning apparatus can be utilized to apply the second sheath 106 to the first corespun yarn 214 in the same manner described above, thereby forming the double corespun yarn 100. In this instance, the low to medium temperature resistant staple fibers of the second sheath 106 are fed through the entrance trumpet 202, and the first corespun yarn 214 is passed through the set of paired drafting rolls 206. The same spiraling action achieved for the first sheath is obtained for the second sheath staple fibers around the first sheath by way of the oppositely operating air jet nozzles 210, 212. The second corespun yarn is then drawn from the second nozzle 212 by the delivery roll assembly 216 and is wound onto the take-up package.

Since the formation of the present yarn on an air jet spinning apparatus does not impart excessive liveliness and torque to the two-plied fiberglass/synthetic core, no problems are experienced with loose and broken ends of the fiberglass/synthetic core protruding outwardly through the first sheath and or the second sheath in the yarn and the fabrics produced therefrom. Since it is possible to produce woven and knitted fabrics utilizing single ends of double corespun yarn, the double corespun yarn can be woven into fine textured fabrics with the double corespun yarn being in the range of from about 30/1 to 1/1 conventional cotton count. This extends the range of fineness of the fabrics which can be produced relative to the types of fabrics heretofore possible to produce by utilizing only double corespun yarns of the prior art.

Figure 3:
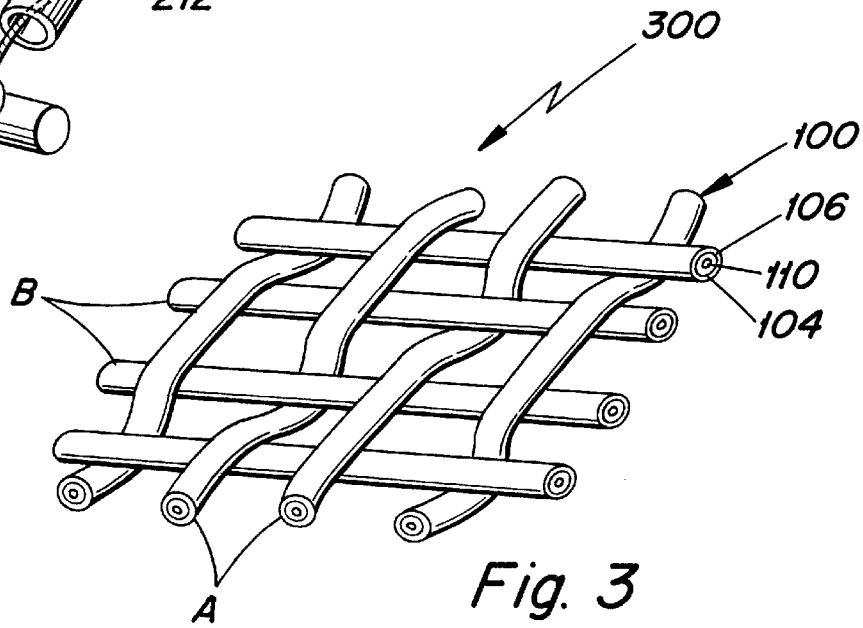
FIG. 3. is a fragmentary isometric view of a portion of a woven fabric in accordance with invention.

The flame resistant multi-corespun yarns described above can advantageously be used in forming fine textured fire resistant barrier decorative fabrics for numerous applications, such as upholstery, mattress and pillow ticking, bed spreads, pillow covers, draperies or cubicle curtains, wallcoverings, window treatments and baby clothing. FIG. 3 illustrates an enlarged view of a portion of an exemplary woven decorative fabric 300 in a two up, one down, right-hand twill weave design. In this exemplified embodiment, the above-described flame retardant multi-corespun yarn is employed for warp yarns A. The material for the filling yarn can be the same or different from that of the warp yarn depending on the second sheathing material. For purposes of illustration, an op en weave is shown to demonstrate the manner in which the warp yarns A and the filling yarns B are interwoven. However, the actual fabric can be tightly woven. For example, the weave can include from about 10 to 200 warp yarns per inch and from about 10 to 90 filling yarns per inch.

While FIG. 3 illustrates a two up, one down, right-hand twill weave design, the described multi-corespun yarns can be employed in any number of designs. For example, the fabric can be woven into various jacquard and doubly woven styles.

Fabrics formed with the described yarns have the feel and surface characteristics of similar types of upholstery fabrics formed of 100% polyolefin fibers while having the desirable fire resistant and flame barrier characteristics not present in upholstery fabric formed entirely of polyolefin fibers. In this regard, the fabrics formed in accordance with the invention meet various standard tests designed to test the fire resistancy of fabrics. For example, one standard test for measuring the fire resistant characteristics of fabrics is Technical Bulletin, California 133 Test Method (Cal. 133), the entire contents of which are herein incorporated by reference. According to this test, a composite manufactured chair upholstered with a fabric to be tested is exposed to an 80 second inverted rectangular Bunsen burner flame. Fabrics employing the above-described fire resistant multi-spun yarns having gone through this test remain flexible and intact, exhibiting no brittleness, melting, or fabric shrinkage. Additional tests, which the formed fabrics meet include the proposed Consumers Product Safety Commission (CPSC) Proposed Flammability Code, the Component Testing on Chair Contents (Britain, France, Germany and Japan) and the Component Testing on Manufactured Chair (Britain, France, Germany and Japan).

When fabrics which have been formed of the balanced double corespun yarn of the present invention are exposed to flame and high heat the first and second sheaths 104, 106 of staple fibers surrounding and covering the core are charred and burned but remain in position around the two-ply fiberglass/synthetic core 102 to create a thermal insulation barrier. The fiberglass core and part of the first sheath 104 of the modacrylic/melamine fiber blend remain intact after the organic staple fiber materials from the second sheath 106 have burned. They form a lattice upon which the char remains, thereby blocking flow of oxygen and other gases through the fabric while providing a structure which maintains the integrity of the fabric after the organic materials of the staple fiber first and second sheaths have been burned and charred. Unlike known fabrics, chemical treatment of the sheath or fabric fibers is not required because the composite multi-corespun yarn is inherently flame resistant. Non-flame retardant coatings may, however, be applied to the surface or backing of the fabric to form a more dimensionally stable fabric depending on the end product use or composite fabric and product application.

Fabrics woven or knit of the double corespun yarn of the present invention may be dyed and printed with conventional dying and printing materials and methods since the outer surface characteristics of the yarn and the fabric formed thereof are determined by the second sheath of low to medium temperature resistant staple fibers surrounding the first sheath and covering the core.

This ability to dye the fabrics is quite surprising to persons skilled in the art given that the fiberglass cores in known fabrics are known to explode during the dye process. This explosion phenomena is believed to be due to excessive heating of the fiberglass core together with the diffusion of sodium into and reaction with the fiberglass core during the dye process. In this regard, the dye process is typically conducted under relatively high temperatures (e.g., 60 to 70° C.), and the cycle chemical is known to pass through the sheathing to the core of known fabrics. Because of this problem, conventional fabrics are limited in post-treatment coloration to various printing processes. The modacrylic/melamine fibers of the first sheath are believed to significantly diffuse the fiberglass/synthetic two-plied core. Additionally, the first sheath is believed to dissipate heat such that the fiberglass filament is not overheated.

The following non-limiting examples are set forth to further demonstrate the formation of multi-corespun yarns produced in accordance with the present invention. These examples also demonstrate that fire resistant fabrics can be formed from these multi-corespun yarns.

EXAMPLES

Example 1

A continuous filament fiberglass was two-plied with a continuous nylon fiber to form a core for the yarn. The fiberglass of the core was ECD 225 1/0 (equivalent to 198 denier) sold by PPG, and the nylon was 20 denier 8 filament (equivalent to a 172 conventional cotton count) from BASF. The core fiber materials had a weight such that the core accounted for 25% by weight of the overall double spun yarn weight. The two-plied core was fed between the paired drafting rolls 206 of the air jet spinning apparatus illustrated in FIG. 2. At the same time, a blended sliver of medium to high temperature resistant modacrylic (Protex® (M))/melamine (BASF Basofil®) fibers was fed into the entrance end of the entrance trumpet 202 to form a first corespun yarn. The blended modacrylic/melarnine sliver had a weight of 45 grains per yard, and a modacrylic/melamine fiber blend of 50/50% by weight, which was obtained by a Truetzschler multi-blending, carding and drawing process. The modacrylic/melamine fibers had a weight such that the first sheath accounted for 25% by weight of the overall double spun yarn weight. The first corespun yarn had a conventional cotton yarn count of 20.

A second sheath material consisted of a 100% polyolefin sliver having a weight of 45 grains per yard and a denier of 532. The polyolefin fibers had a weight such that the second sheath accounted for 50% by weight of the overall yarn weight. These fibers were fed into the entrance end of the entrance trumpet 202. At the same time, the first corespun yarn having a weight necessary to account for 50% by weight of the overall double spun yarn weight was fed between the paired drafting rolls 206. A double corespun yarn was thereby formed. The double corespun yarn achieved by this air jet process had a 10/1 conventional cotton count.

Example 2

A continuous filament fiberglass was two-plied with a continuous nylon fiber to form a core for the yarn. The fiberglass of the core was ECD 450 1/0 (equivalent to 98 denier) sold by PPG, and the nylon was 20 denier 8 filament (equivalent to a 172 conventional cotton count) from BASF. The core fiber materials had a weight such that the core accounted for 25% by weight of the overall double spun yarn weight. The twoplied core was fed between the paired drafting rolls 206 of the air jet spinning apparatus illustrated in FIG. 2. At the same time, a blended sliver of medium to high temperature resistant modacrylic (Protex® (M))/melamine (BASF Basofil®) fibers was fed into the entrance end of the entrance trumpet 202 to form a first corespun yarn. The blended modacrylic/melamine sliver had a weight of 45 grains per yard, and a modacrylic/melamine fiber blend of 50/50% by weight, which was obtained by a Truetzschler multi-blending, carding and drawing process. The modacrylic/melamine fibers had a weight such that the first sheath accounted for 25% by weight of the overall double spun yarn weight. The first corespun yarn had a conventional cotton yarn count of 30.

A second sheath material consisted of a 100% polyolefin sliver having a weight of 45 grains per yard and a denier of 532. The polyolefin fibers had a weight such that the second sheath accounted for 50% by weight of the overall yarn weight. These fibers were fed into the entrance end of the entrance trumpet 202. At the same time, the first corespun yarn having a weight necessary to account for 50% by weight of the overall double spun yarn weight was fed between the paired drafting rolls 206. A double corespun yarn was thereby formed. The double corespun yarn achieved by this air jet process had a 15/1 conventional cotton count.

Example 3

The double corespun samples resulting from Examples 1 and 2 were each employed as the filling yarn in the woven process to form a respective fabric sample as illustrated in FIG. 3. The fabrics had 90 warp yarns per inch and 40 filling yarns per inch. The double corespun yarn had a 10/1 conventional cotton count in the filling and a 15/1 conventional cotton count in the warp to form an 8.5 ounce per square yard, two up, one down, right-hand twill weave fabric.

The fabrics were subjected to the standard test described in Technical Bulletin, California 133 Test Method (Cal. 133). The fabrics were each found to remain flexible and intact, exhibiting no brittleness, melting, or fabric shrinkage. The second sheath of polyolefin fibers was burnt and charred. However, the charred portions remained in position surrounding the core and the first sheath. These results indicate that the two-plied core and first sheath effectively provide a thermal insulation barrier and limited movement of vapor through the fabric, while, in addition, the fiberglass/synthetic core and the first sheath modacrylic/melamine blend also provide a grid system, matrix or lattice which prevents rupture of the upholstery fabric and penetration of the flame through the upholstery fabric and onto the material of which the chair was formed.

While the invention has been described in detail with reference to specific embodiments thereof, it will be apparent to one skilled in the art that various changes and modifications can be made, and equivalents employed, without departing from the scope of the appended claims.

What is claimed is:

1. A fire resistant corespun yarn, comprising:

a core of a high temperature resistant continuous filament comprising fiberglass;

a first sheath comprising two or more different types of synthetic fibers surrounding the core, wherein a first type of the synthetic fibers is effective to char and expand when exposed to open flame, and a second type of the synthetic fibers is a high temperature resistant, brittle fiber; and a second sheath of staple fibers surrounding the first corespun yarn.

2. The fire resistant corespun yarn according to claim 1, wherein the core has a multi-ply structure.

3. The fire resistant corespun yarn according to claim 2, wherein the multi-ply structure comprises a low temperature resistant continuous filament synthetic fiber selected from the group consisting of polyethylene, nylon, polyester and polyolefin, two-plied with the fiberglass filament.

4. The fire resistant corespun yarn according to claim 1, wherein the second sheath staple fibers are of a material selected from the group consisting of cotton, wool, nylon, polyester, polyolefin, rayon, acrylic, silk, mohair, cellulose acetate, and blends thereof.

5. The fire resistant corespun yarn according to claim 4, wherein the second sheath staple fibers are cotton or polyolefin fibers.

6. The fire resistant corespun yarn according to claim 5, wherein the core is from about 15 to 35% by weight based on the total weight of the corespun yarn, and the second sheath is from about 35 to 80% by weight based on the total weight of the corespun yarn.

7. The fire resistant corespun yarn according to claim 6, wherein the core is about 25% by weight based on the total weight of the corespun yarn, and the second sheath is about 50% by weight based on the total weight of the corespun yarn.

8. The fire resistant corespun yarn according to claim 1, wherein the size of the corespun yarn is from about 30/1 to 1/1 conventional cotton count.

9. The fire resistant corespun yarn according to claim 1, wherein the first and second types of the synthetic fibers are present in the first sheath in an amount of from about 50 to 90% by weight and from about 10 to 50% by weight, respectively, based on the total weight of the first sheath.

10. A fire resistant corespun yarn, comprising:

a two-plied core of a high temperature resistant continuous filament comprising fiberglass and a low temperature resistant continuous filament synthetic fiber selected from the group consisting of polyethylene, nylon, polyester and polyolefin;

a first sheath comprising two or more different types of synthetic fibers surrounding the core, wherein a first type of the synthetic fibers is effective to char and expand when exposed to open flame, and a second type of the synthetic fibers is a high temperature resistant, brittle fiber; and a second sheath of staple fibers surrounding the first corespun yarn, wherein the core is from about 15 to 35% by weight based on the total weight of the corespun yarn, and the second sheath is from about 35 to 80% by weight based on the total weight of the corespun yarn.

11. A fire resistant fabric, comprising:

a fire resistant fabric substrate, the substrate comprising:

a fire resistant corespun yarn, the yarn comprising:

a core of a high temperature resistant continuous filament comprising fiberglass;

a first sheath comprising two or more different types of synthetic fibers surrounding the core, wherein a first type of the synthetic fibers is effective to char and expand when exposed to open flame, and a second type of the synthetic fibers is a high temperature resistant, brittle fiber; and a second sheath of staple fibers surrounding the first corespun yarn.

12. The fire resistant fabric according to claim 11, wherein the core further comprises a low temperature resistant continuous filament synthetic fiber selected from the group consisting of polyethylene, nylon, polyester and polyolefin, two-plied with the fiberglass filament.

13. The fire resistant fabric according to claim 11, wherein the second sheath staple fibers are of a material selected from the group consisting of cotton, wool, nylon, polyester, polyolefin, rayon, acrylic, silk, mohair, cellulose acetate, and blends thereof.

14. The fire resistant fabric according to claim 12, wherein the core is from about 15 to 35% by weight based on the total weight of the corespun yarn, and the second sheath is from about 35 to 80% by weight based on the total weight of the corespun yarn.

15. The fire resistant fabric according to claim 11, wherein the fabric is free of a fire resistant coating.

16. A product upholstered with the fire resistant fabric of claim 11.

17. The product of claim 16, wherein the fabric is free of a fire resistant coating.

18. The product of claim 16, wherein the product is a composite chair, a mattress or a panel fabric furniture system.

19. The product of claim 16, wherein the fabric is free of a barrier fabric.

20. The product of claim 16, wherein upon exposure of the fabric to flame, the first sheath is effective to partially burn and char around the core, thereby preventing rupture and creating oxygen depletion to the product below the fabric.

* * * * *